United States Patent [19]

Hehn et al.

[11] Patent Number: 4,871,065

[45] Date of Patent: Oct. 3, 1989

[54] COMPACT DISC SECURITY PACKAGE

[75] Inventors: Bruce A. Hehn, Massillon; Andrew W. Moock, Brecksville, both of Ohio

[73] Assignee: Alpha Enterprises, Inc., Canton, Ohio

[21] Appl. No.: 234,375

[22] Filed: Aug. 19, 1988

[51] Int. Cl.[4] ..... B65D 85/672

[52] U.S. Cl. ..... 206/387; 206/807; 206/309

[58] Field of Search ..... 206/387, 309, 807, 1.5

[56] References Cited

U.S. PATENT DOCUMENTS

| | | | |
|---|---|---|---|
| 3,576,238 | 4/1971 | Chubb | 190/120 |
| 3,871,516 | 3/1975 | Holkestad et al. | 206/45.31 |
| 4,381,836 | 5/1983 | Rivkin et al. | 206/387 |
| 4,589,549 | 5/1986 | Hehn | 206/387 |
| 4,718,547 | 1/1988 | MacTavish | 206/309 |
| 4,805,769 | 2/1989 | Soltis et al. | 206/387 |

*Primary Examiner*—Carroll B. Dority

*Attorney, Agent, or Firm*—Michael Sand Co.

[57] ABSTRACT

A reusable one-piece molded plastic package for securely holding and displaying digital audio compact discs. A housing forms a storage compartment having an access opening for receiving a container of the type having opposite end portions and a compartment formed in at least one of the end portions for receiving a rectangular storage box containing a compact disc. A cover is hingedly mounted on the housing and is pivotally moved toward the storage compartment to a closed position to secure a compact disc container therein. A pair of locking projections, are formed on the cover and engage camming surfaces and locking tabs formed on the housing to lockingly engage the cover with the housing. A manually operated key releases the locking tabs from engagement with the locking projections enabling the cover to be disengaged from the housing and moved to an open position.

16 Claims, 5 Drawing Sheets

COMPACT DISC SECURITY PACKAGE

TECHNICAL FIELD

The invention relates to packages and in particular to a package for holding a digital audio compact disc container. More particularly, the invention relates to a reusable compact disc security package having a lockable cover which prevents unauthorized removal of the compact disc container from the package, and in which the improved package may be displayed in a usual LP record disc display rack.

BACKGROUND ART

A recent development in the recording industry is the digital audio compact disc system. In this system, sound is reproduced on a small, convenient sound carrier unit. The disc is approximately 4½ inches in diameter and produces a unique combination of digital playback with laser optics. These compact discs, as they are referred to in the audio industry, are becoming increasingly popular in the United States and many foreign countries and are approaching outselling usual LP record discs.

The introduction of compact discs into the audio market has presented a problem to the retail sellers thereof in that the discs must be displayed so that prospective purchasers can inspect the same to determine the artist, songs, etc., thereon. This presents a security problem due to the extremely small size of the compact discs in contrast to LP record discs.

Existing LP record discs are placed on their edges and displayed in racks since theft of the discs is extremely difficult due to their large size, which generally is 12 inches by 12 inches. However, such open rack display of compact discs is extremely vulnerable to theft problems. Therefore, various packaging devices have been devised which enable the compact disc to be displayed for sale vertically in usual LP record disc display racks.

Various types of packages have been developed and are intended to provide a safe and secure device for displaying the compact discs while retarding removal of the same from the package and subsequent theft from the store. Such packages usually are elongated, rectangular containers which have opposite end portions and a compartment formed in at least one of the end portions for receiving a rectangular storage box or "jewel box" which contains the compact disc. These elongated compact disc containers typically are formed of either cardboard, a rigid plastic having openings formed therein for viewing the contents of the disc, or a transparent, flexible "blister" plastic. The cardboard container typically is wrapped in a clear plastic heat-shrink paper after the jewel box containing the disc has been placed in the container, which requires the disc distributor or retailer to purchase a heat-shrink wrapping machine and manually wrap each container.

Although these known prior art packages do enable the compact discs to be displayed in a usual LP record disc cabinet, it has been found that they fail to effectively deter theft of the compact discs. A thief can merely conceal the entire cardboard or plastic container under a shirt or coat or, alternatively, such containers are easily opened so that the much smaller jewel box or disc itself can be concealed for removal from the store.

The closest known prior art to the present invention is shown in U.S. Pat. No. 4,718,547. However, there are important differences between the compact disc security package disclosed in this patent and our present invention. More particularly, the package shown in this patent has a hinged closure member for permanently holding a usual compact disc container therein. However, the security package is not reusable since the closure member remains permanently locked and the package must be cut or otherwise destroyed or mutilated to remove the disc container from the package. In comparison, the cover or closure member of our package is releasably secured in the closed position for holding a disc container therein for store display. The cover can be unlocked by a store clerk by using a specially designed key, and the compact disc container therein removed for sale to a purchaser so that the package can be reused for displaying another compact disc.

Therefore, the need exists for an improved compact disc security package which can be displayed in the usual LP record disc storage racks and which can be produced inexpensively yet is sufficiently strong and durable so as to be reusable. Furthermore, the need exists for a compact disc package which is inexpensive to manufacture, yet which is sophisticated enough to thwart the retail store compact disc thief. There is no known compact disc security package of which I am aware that provides these features and advantages.

DISCLOSURE OF THE INVENTION

Objectives of the invention include providing an improved compact disc security package which can be mass-produced relatively inexpensively as an integral one-piece plastic member, one part of which forms the main housing and another part being a cover pivotally attached to and lockingly engageable with the housing for securing a compact disc container in the housing; and in which the package can be manually loaded with a compact disc container by retail shop owners and without heat-shrink wrapping of the package after the compact disc container is placed therein.

Another objective is to provide such a package in which the printed information on the compact disc container is visible through enlarged openings formed in the top and bottom faces of the housing which form the package and through the semi-transparent material of the package, and in which a compact disc container is easily slid into a storage compartment formed in the housing and secured therein by the easily operated manual locking cover to prevent unauthorized removal of the compact disc from the package.

A further objective is to provide such an improved package in which an inexpensive key formed of molded plastic is insertable into openings formed in the cover enabling the cover to be disengaged from the housing and moved to an open position for removal of the compact disc container from its storage compartment upon completion of a sale enabling the package to be reused for storing another compact disc container; and in which the key and lock means are sufficiently different from and more complex than those found in some prior security packages to prevent or deter attempts by thieves to open the lock with car keys or other similar devices.

A still further objective is to provide such a package which can be molded of rugged plastic material and reused, thereby reducing the cost to the manufacturer and distributor of the compact discs. Another objective of the invention is to provide such a package in which the housing has an exterior size and configuration which enables the compact disc container to be displayed in a usual LP record display case enabling purchasers to leaf through a plurality of compact disc packages and inspect the contents of the individual compact discs in their packages through openings formed in the top and bottom faces of the housing.

Still another objective is to provide such a package in which the elongated, flat and generally rectangular shape of the housing has projections formed thereon making the package more difficult to conceal for theft of the compact disc contained therein.

A further objective is to provide such a package which is of an extremely simple construction, which achieves the stated objectives in a simple, effective and inexpensive manner, and which solves problems and satisfies needs in the art.

These and other objectives and advantages of the invention are obtained by the improved compact disc security package construction for holding an elongated, rectangular container of the type having opposite end portions and a compartment formed in at least one of the end portions for receiving a rectangular storage box containing a digital audio compact disc, the general nature of which may be stated as including a housing having a storage compartment formed therein, the compartment having an access opening for inserting and removing a compact disc container into and from the compartment; a cover pivotally mounted on the housing and movable between open and closed positions for allowing and preventing, respectively, insertion and removal of a compact disc container into and from the access opening of the storage compartment; lock means for releasably securing the cover in the closed position, the lock means comprising at least one locking tab and at least one camming surface formed on the housing, and further comprising at least one locking projection formed on the cover, so that the locking projection is slideably engageable with the camming surface and locking tab for retaining the cover in the closed position; and separate key means engageable with the housing locking tab for moving the tab out of engagement with the cover locking projection to enable the cover to be slid from locking engagement with the housing and moved to the open position for removing a compact disc container from the storage compartment through the access opening.

BRIEF DESCRIPTION OF THE DRAWINGS

A preferred embodiment of the invention, illustrative of the best mode in which applicants have contemplated applying the principles, is set forth in the following description and is shown in the drawings and is particularly and distinctly pointed out and set forth in the appended claims.

Similar numerals refer to similar parts throughout the drawings.

BEST MODE FOR CARRYING OUT THE INVENTION

Figure 1:
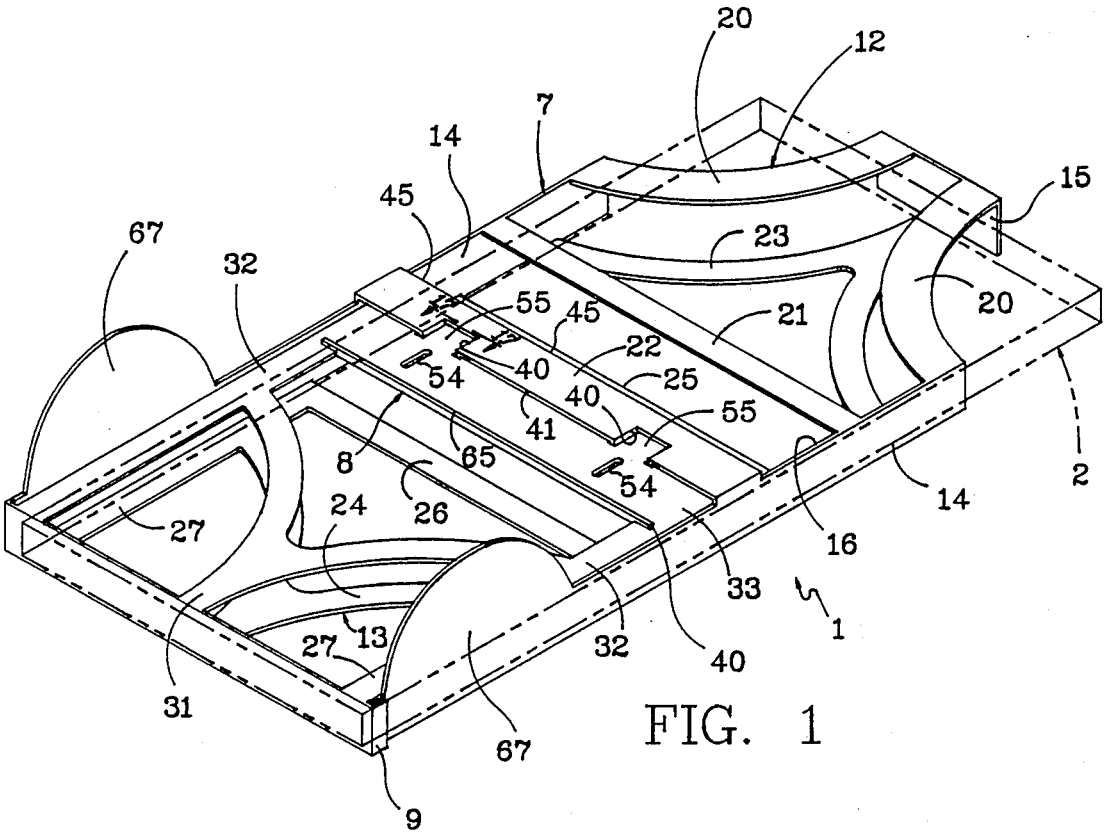
FIG. 1 is a perspective view of the compact disc security package of the invention in the closed and locked position and holding a compact disc container therein which is shown in dot-dash lines.
Figure 2:
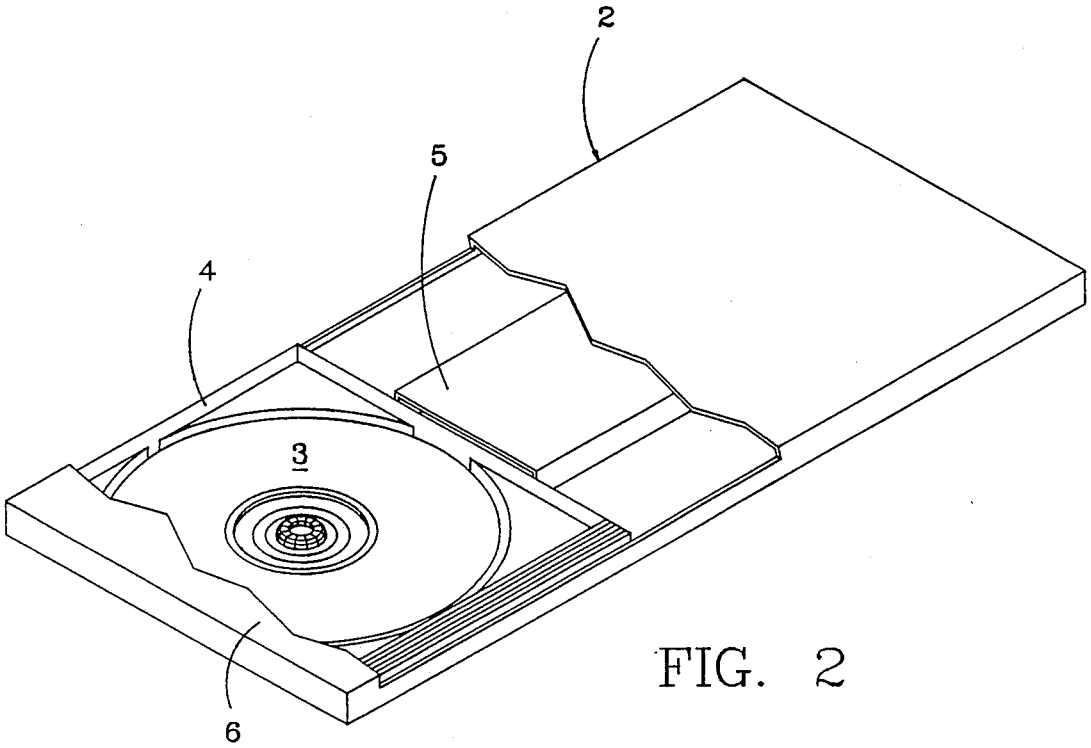
FIG. 2 is a perspective view, with portions broken away, of a usual compact disc container for insertion into the storage compartment of the security package of FIG. 1.

The improved compact disc security package of the invention is indicated generally at 1, and is shown in FIG. 1 holding a usual compact disc container 2. Container 2 is shown in FIG. 2 and is of the type used for retail store display of a digital audio compact disc 3 and to prevent unauthorized removal of the compact disc from the store. Security package 1 is a modification of a prior security package described in pending U.S. patent application Ser. No. 117,310, which is assigned to the same assignee as is the present application.

Compact disc 3 typically reach the retail store packaged in a rectangular storage or "jewel" box 4, which in turn is packaged within container 2, as shown in FIG. 2. Container 2 is elongated and rectangular and has a cardboard-reinforced end 5 and a hollow jewel box-containing end 6. Container 2 typically is wrapped in a clear plastic heat-shrink paper.

Figure 3:
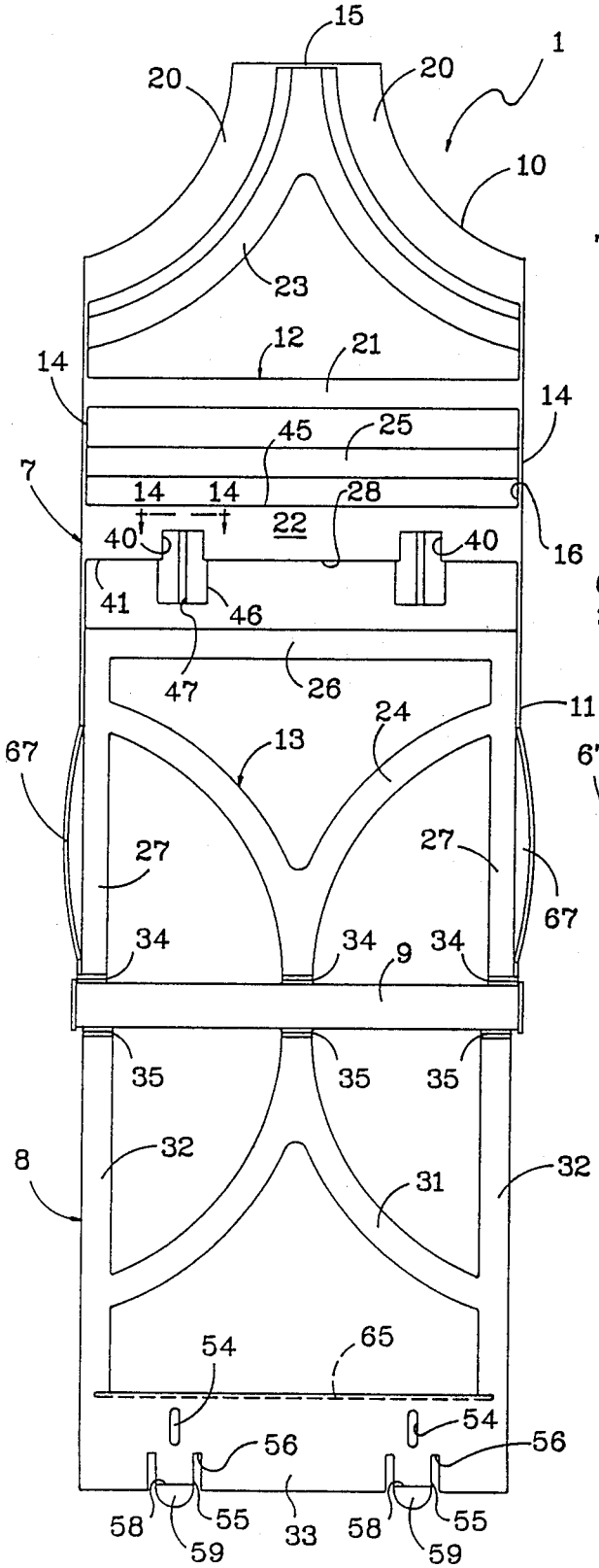
FIG. 3 is a top plan view of the security package in a fully open unlocked position.

Compact disc package 1 is formed as a one-piece molded plastic unit, which preferably is formed of high-impact polypropylene or other suitable moldable plastic. Package 1 includes a housing, indicated generally at 7, and a cover, indicated generally at 8, which is pivotally connected to housing 7 by a double-hinged plate 9, as best shown in FIG. 3. Housing 7 is elongated and generally rectangular-shaped and has a generally closed end 10 and an opposite generally open end 11 adjacent hinge plate 9. Housing 7 includes spaced top and bottom faces 12 and 13, a spaced pair of similar side walls 14, and a closed end wall 15. Housing faces 12 and 13 and walls 14 and 15 define a storage compartment 16 having dimensions which are complementary to and slightly larger than the size of a usual compact disc container 2, as best seen in FIG. 4.

Figure 4:
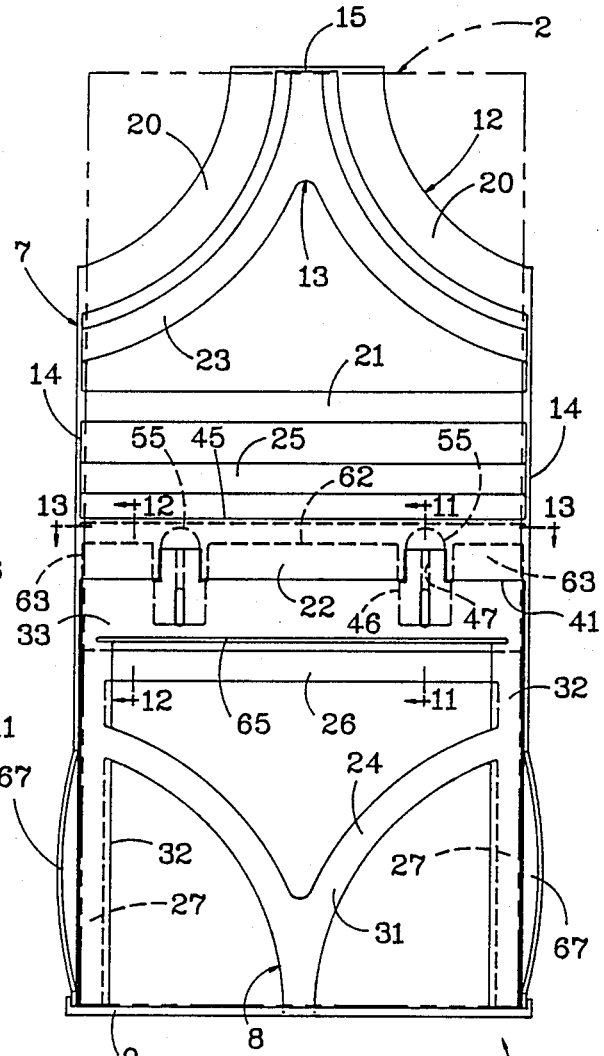
FIG. 4 is a top plan view of the security package in the closed and locked position and holding a compact disc container therein which is shown in dot-dash lines.

Top face 12 includes a pair of arcuate-shaped ribs 20 and first and second transverse ribs 21 and 22 (FIGS. 1, 3 and 4). Arcuate-shaped ribs 20 extend between closed end wall 15 and side walls 14. First transverse rib 21 extends between side walls 14 and is spaced from arcuate ribs 20. Second transverse rib 22 extends between side walls 14 and is spaced from first transverse rib 21, and generally bisects housing 7 into closed and open ends 10 and 11.

Bottom face 13 includes first and second generally V-shaped ribs 23 and 24, first and second transverse ribs 25 and 26, and a spaced pair of longitudinally extending side flanges 27 (FIGS. 1, 3 and 4). First V-shaped rib 23 extends between closed end wall 15 and side walls 14. First transverse rib 25 extends between side walls 14 and is spaced from first V-shaped rib 23, and second transverse rib 26 extends between side walls 14 and is spaced from first transverse rib 25. Side flanges 27 extend along side walls 14 and between second transverse rib 26 and hinge plate 9. Second V-shaped rib 24 extends between double-hinged plate 9 and side flanges 27 and is spaced from second transverse rib 26.

Figure 13:
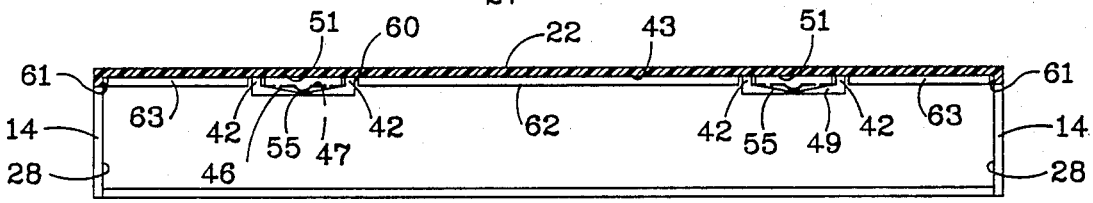
FIG. 13 is an enlarged sectional view taken on line 13—13, FIG. 4, particularly showing the cover guide tabs fully engaged with the housing U-shaped channels.

The spaced arrangement of ribs and flanges 20–27 of housing top and bottom faces 12 and 13 provides for retaining a compact disc container 2 within storage compartment 16, and also for enabling the contents of the compact disc 3 contained therein, such as the artist, songs, etc. which are printed on container 2, to be viewed by a prospective purchaser without removing the container from package 1 (FIGS. 1 and 4). Furthermore, a generally rectangular access opening 28 is formed in housing 7 and is defined by second transverse rib 22, housing side walls 14, and bottom face 13 (FIGS. 3 and 13). Access opening 28 provides for inserting and removing a cassette into and from storage compartment 16.

Figure 5:
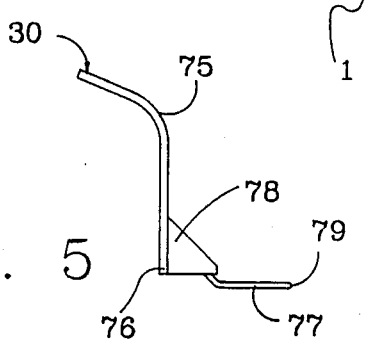
FIG. 5 is an end elevational view of the key.
Figure 6:
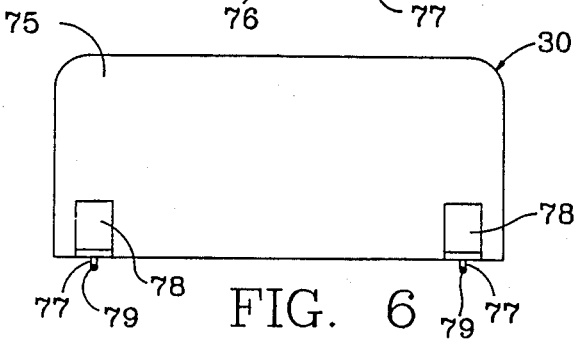
FIG. 6 is a side elevational view of the key of FIG. 5.

In accordance with one of the features of the invention, cover 8 (FIG. 3) is pivotally mounted on and lockingly engageable with housing 7 for locking a compact disc container 2 in storage compartment 16 until the container is removed by a sales clerk by use of a manually operated key, indicated generally at 30 and shown in FIGS. 5 and 6. Cover 8 comprises a generally V-shaped rib 31, a spaced pair of longitudinally extending side flanges 32, and a transverse end member 33. Cover 8 is integrally, hingedly attached to bottom face 13 of housing 7 by double-hinged plate 9. Plate 9 has a plurality of first hinges 34 which are integral with housing side flanges 27 and second V-shaped rib 24. A plurality of second hinges 35 are integral with cover side flanges 32 and V-shaped rib 31. Each side flange 32 extends between hinge plate 9 and transverse end member 33, and V-shaped rib 31 extends between the plate and side flanges 32.

A pair of spaced rectangular cutouts 40 are formed in a first transverse edge 41 of second transverse rib 22 of top face 12 (FIGS. 1 and 3). First transverse edge 41 is adjacent to open end 11 of housing 7. A pair of spaced nubs 42 (FIG. 13) extend outwardly of a bottom surface 43 of transverse rib 22 adjacent to each cutout 40. A reinforcing rib 44 (FIG. 9) extends along an opposite second transverse edge 45 of rib 22 to increase the strength thereof and reduce flexing of the rib.

Figure 14:
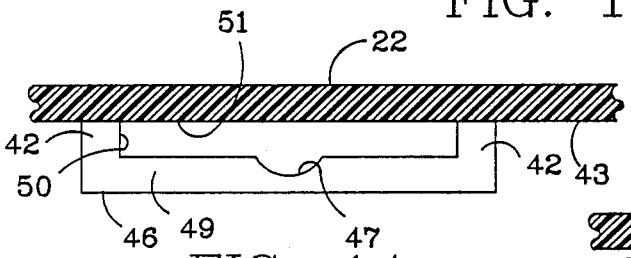
FIG. 14 is a greatly enlarged fragmentary sectional view taken on line 14—14, FIG. 3, particularly showing the slot formed between one of the locking tabs and the second transverse rib of the top face.

A resilient rectangular locking tab 46 is formed integrally with each pair of nubs 42 of second transverse rib 22 and is spaced from the rib (FIGS. 3 and 13). Locking tabs 46 have a longitudinally extending, semicircular-shaped channel 47 formed therein. A catch 49 (FIG. 9) also is formed on locking tab 46, the operation of which is described in greater detail below. A slot 50 is formed between each locking tab 46 and second transverse rib 22 (FIG. 14). A camming surface 51 (FIG. 9) is formed on bottom surface 43 of rib 22 adjacent to each locking tab 46.

Figure 9:
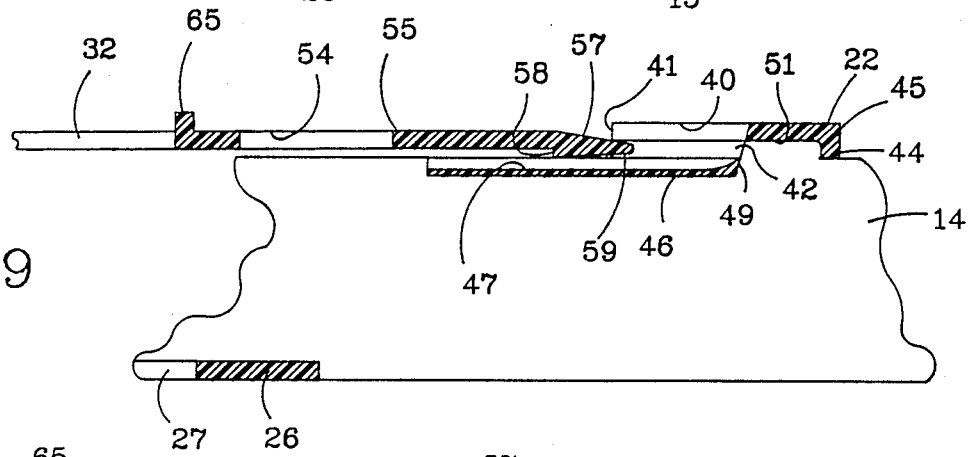
FIG. 9 is a greatly enlarged fragmentary sectional view, showing the position of one of the cover locking projections just prior to sliding engagement with one of the camming surfaces and one of the locking tabs of the housing.

A pair of spaced locking projections 55 is formed on and project outwardly of a first transverse edge 56 of transverse end member 33 of cover 8 (FIG. 3). Locking projections 55 have a tapered top surface 57, and an undercut 58 is formed on a bottom surface 59 thereof (FIG. 9). An opening 54 is formed in transverse end member 33 adjacent to each locking projection 55 and functions as a key opening through which key 30 (FIGS. 5 and 6) is inserted when it is desired to disengage cover 8 from housing 7.

A central, inverted generally U-shaped channel 60 is defined by bottom surface 43 of second transverse rib 22 and the innermost ones of nubs 42, and a pair of outer, inverted generally U-shaped channels 61 are defined by bottom surface 43 of rib 22, side walls 14, and the outermost ones of nubs 42 (FIG. 13). U-shaped channels 60 and 61 are adapted to be slideably engaged by a complementary-sized and shaped central guide tab 62 and a pair of outer guide tabs 63. Guide tabs 62 and 63 are formed on and extend outwardly of first transverse edge 56 of cover end member 33 (FIG. 3). A top surface 64 of guide tabs 62 and 63 (FIG. 12) is tapered to aid insertion of the tabs into channels 60 and 61. A reinforcing rib 65 (FIGS. 1, 4 and 9) is formed on transverse end member 33 for providing a manual grasping surface, for increasing the strength of and reduce flexing of the end member, and for being engaged by key 30 to assist in unlocking cover 8 from housing 7 as described in detail below.

A semicircular-shaped ear 67 extends upwardly from and is generally coplanar with each sidewall 14 on open end 11 of housing 7 to add bulk to package 1 to reduce the possibility of concealment of the package and theft from a retail store.

Figure 7:
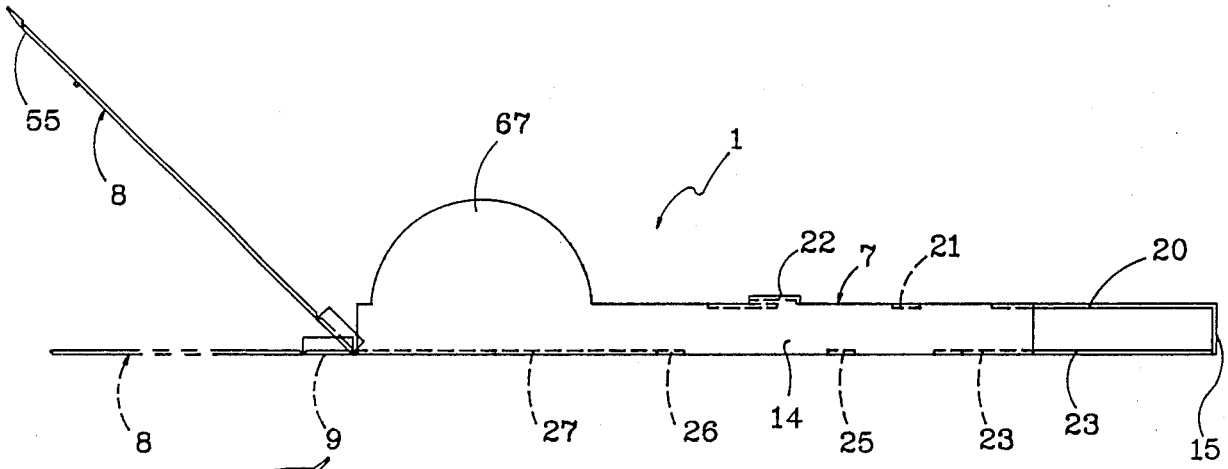
FIG. 7 is a fragmentary side elevational view of the security package of FIG. 3, showing in phantom lines the cover in a fully open unlocked position and in full lines in a partial open position and prior to locking engagement with the housing.
Figure 8:
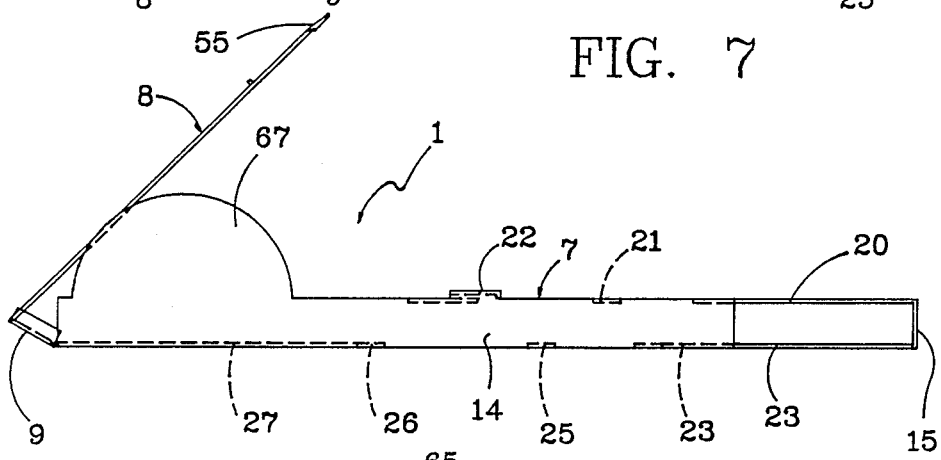
FIG. 8 is a view similar to FIG. 7, showing the cover moving closer to the closed position.
Figure 10:
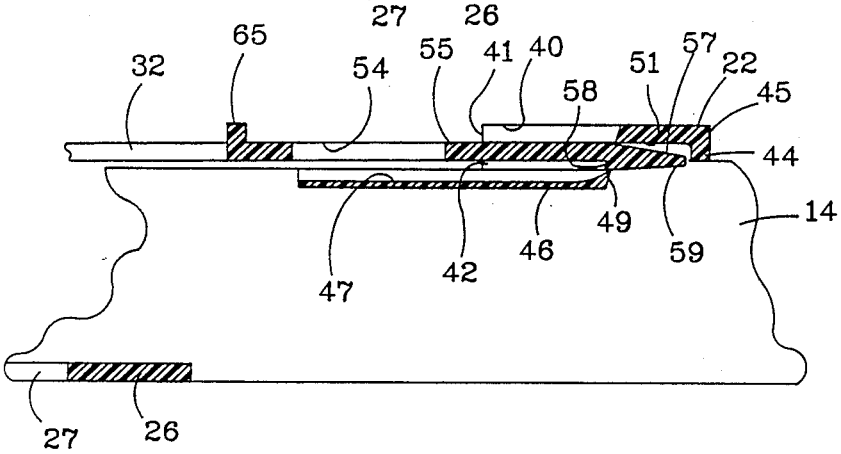
FIG. 10 is a view similar to FIG. 9, showing the locking projection engaging the camming surface and locking tab.
Figure 15:
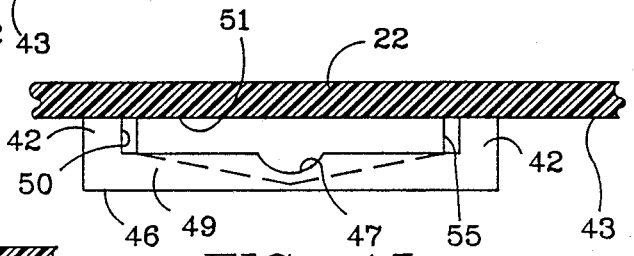
FIG. 15. is a view similar to FIG. 14, showing the position of one of the cover locking projections just prior to sliding engagement with one of the camming surfaces and one of the locking tabs as in FIG. 9.
Figure 16:
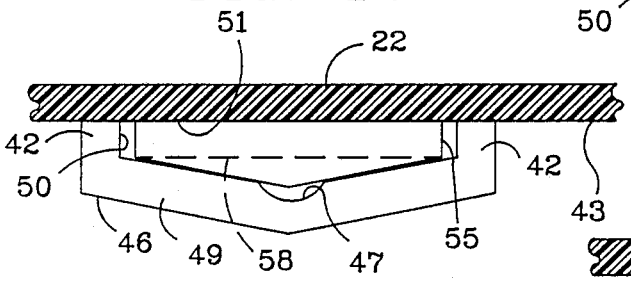
FIG. 16 is a view similar to FIGS. 14 and 15, showing the locking projection engaging the camming surface and locking tab as in FIG. 10.

The operation, features and advantages of improved compact disc security package 1, and in particular the operation of improved locking cover 8, is best understood by referring to FIGS. 7 through 17. Cover 8 is pivotally moved from its fully open position of FIG. 3, through the various positions as shown in FIGS. 7 and 8, to a position as shown in FIGS. 9 and 15 wherein cover 8 is closed but not yet engaged with housing 7. Cover 8 then is manually slid forwardly by gripping reinforcing rib 65 of transverse end member 33, with tapered top surfaces 57 of locking projections 55 contacting camming surfaces 51 of second transverse rib 22. As locking projections 55 continue to move forwardly through slot 50, camming surfaces 51 urge the locking projections downwardly against catch 49 of locking tabs 46 causing the resilient tabs to flex downwardly, as shown in FIGS. 10 and 16. As undercuts 58 of the locking projections move forwardly past catches 49 of the locking tabs, the resilient tabs snap back to their normal position to engage the undercuts for securely locking the cover in the closed position.

Figure 12:
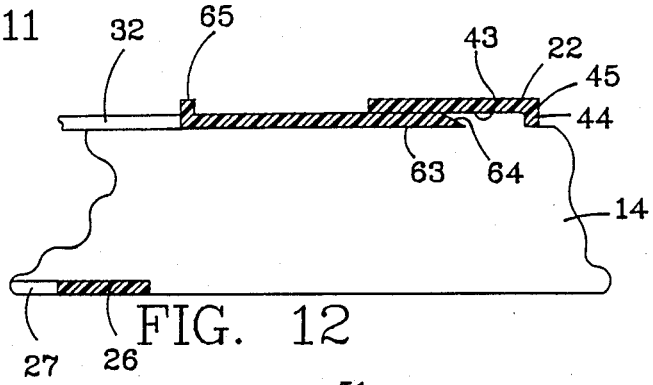
FIG. 12 is an enlarged fragmentary sectional view taken on line 12—12, FIG. 4, showing one of the outer guide tabs of the cover engaged with its respective outer U-shaped channel of the housing.

Central guide tab 62 slideably engages central U-shaped channel 60 and outer guide tabs 63 slideably engage outer U-shaped channels 61 simultaneously with the sliding engagement of locking projections 55 with housing 7 described above, to assist in aligning the locking projections with slots 50 and further to assist in maintaining cover 8 in locking engagement with the housing (FIGS. 12 and 13).

Figure 11:
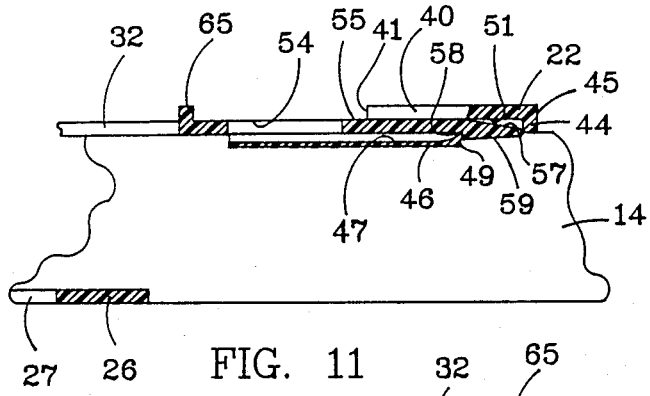
FIG. 11 is an enlarged view similar to FIGS. 9 and 10 taken on line 11—11, FIG. 4, showing the locking projection fully engaged with the locking tab.
Figure 17:
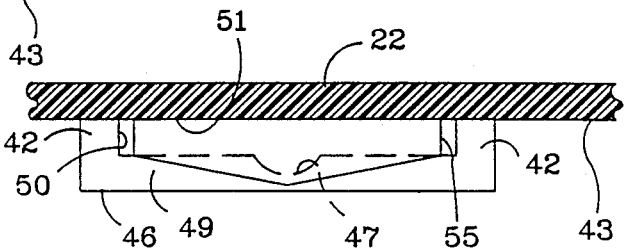
FIG. 17 is a view similar to FIGS. 14–16 taken on line 17—17, FIG. 1, showing the locking projection fully engaged with the locking tab as in FIG. 11.

When locking projections 55 are in their forwardmost locked positions as shown in FIGS. 11 and 17, cover 8 is prevented from being moved to an unlocked rearward position by the engagement of catches 49 of locking tabs 46 with undercuts 58 of locking projections 55. The engagement of first transverse edge 56 of cover end member 33 with nubs 42 of housing rib 22 (not shown), limits the forward movement of the cover and locking projections 55 to a location just beyond the catches 49 of locking tabs 46. Pivotal upward movement of cover 8 is prevented by engagement of locking projections 55 with rib 22.

When the cover is in its frontward locked position as shown in FIGS. 1 and 4, a compact disc container is securely retained within storage compartment 16 and unauthorized removal is prevented by arcuate-shaped ribs 20, first and second transverse ribs 21 and 22 of top face 12; transverse end member 33, side flanges 32 and V-shaped rib 31 of cover 8; first and second V-shaped ribs 23 and 24, first and second transverse ribs 25 and 26, and side flanges 27 of bottom face 13; and closed end wall 15, double-hinged plate 9 and side walls 14. The cover cannot be moved in a rearward direction due to the engagement of locking projections 55 with locking tabs 46 until the tabs are disengaged therefrom by use of key 30.

Key 30 (FIGS. 5 and 6) includes a curved, generally rectangular-shaped plate 75 provided with a pair of unlocking tangs 77, preferably formed of metal, which are molded within a pair of reinforcing blocks 78 and project outwardly from one end of plate 75 at an angle. Plate 75 and reinforcing blocks 78 preferably are integrally molded as a one-piece plastic member formed of a high-strength polystyrene or similar plastic material.

Figure 18:
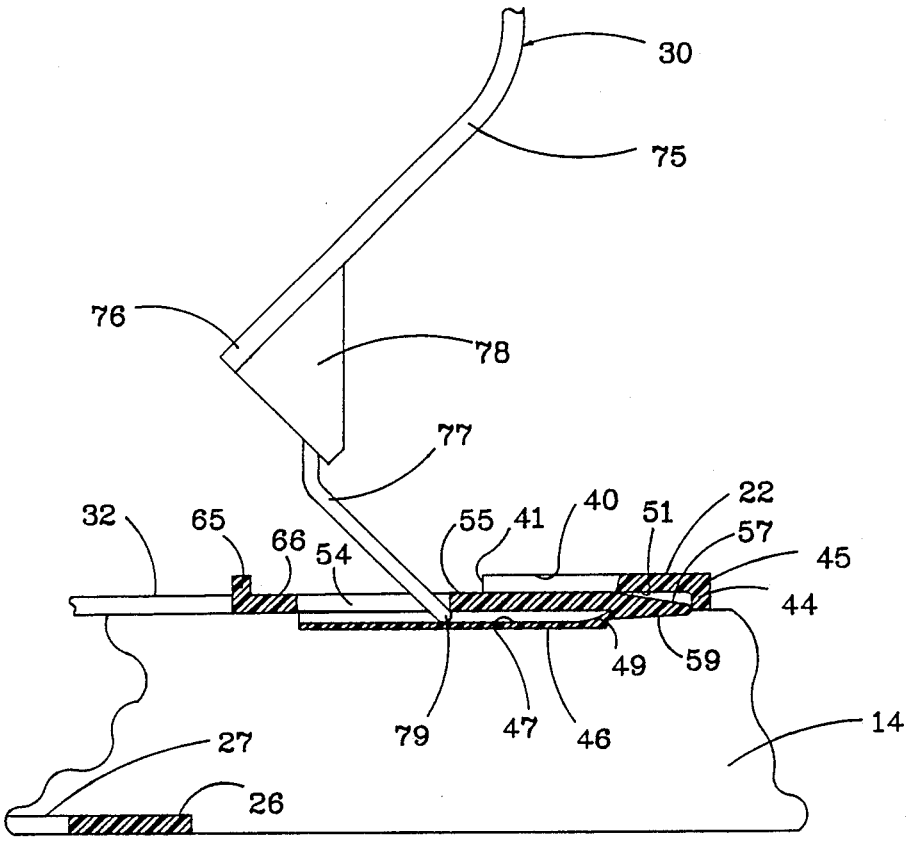
FIG. 18 is an enlarged view similar to FIG. 11, showing one of the key tangs passing through one of the cover key openings and starting to enter the semicircular channel of one of the locking tabs.
Figure 19:
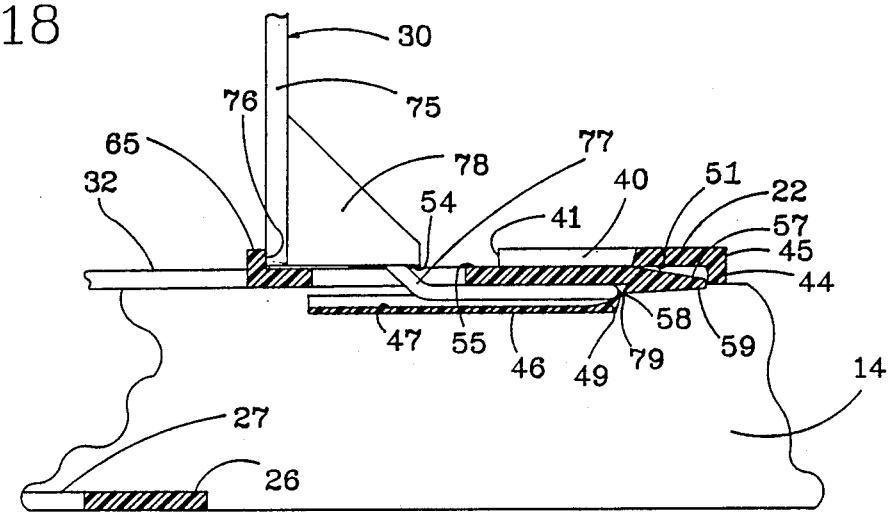
FIG. 19 is a view similar to FIG. 18, showing the key tang engaged with the locking tab catch for unlocking the cover.
Figure 20:
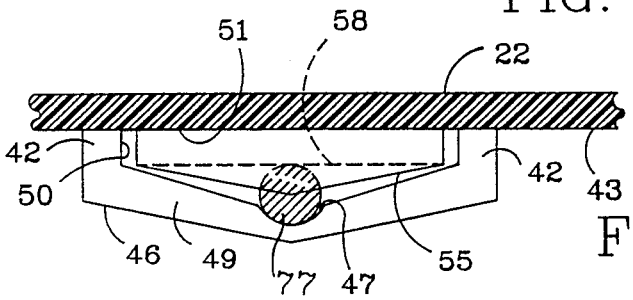
FIG. 20 is a view similar to FIGS. 14–17, showing the key tang engaging the locking tab catch as in FIG. 19.

To unlock tabs 46 from engagement with locking projections 55, each tang 77 of key 30 is inserted from the top of cover 8 through a respective one of the pair of openings 54 formed in transverse end member 33 of the cover (FIG. 18). As key 30 is manually moved forwardly, tangs 77 slide along the semicircular channels 47 formed in locking tabs 46. Camming surfaces 79 formed on the outer pointed ends of tangs 77 engage the catches 49 of locking tabs 46 forcing the front end of the tabs downwardly and increasing the size of slots 50 to provide sufficient clearance for the rearward movement of locking projections 55 through the slots by engagement of a heel 76 of key 30 with reinforcing rib 65, and thus disengagement of cover 8 from housing 7 (FIGS. 19 and 20). The cover then is pivotally moved to the fully open position of FIG. 3 to permit easy removal of the compact disc container from its stored position out through access opening 28.

Thus, compact disc security package 1 of the present invention provides a reusable, low-cost, sturdy device for the display of compact discs in retail outlets, and allows a prospective purchaser to browse through the compact discs without the assistance of a sales clerk while discouraging and retarding theft of the compact discs. When a purchaser decides to purchase a compact disc, he or she takes the security package and its contents to a store clerk. The clerk removes the compact disc container from the package by using the key, then reloads the package with another compact disc container and returns the same to the display rack for sale. In addition, unsold compact discs can be returned to the distributor by the retailer. The unsold disc containers then are removed from the package by a clerk using a key and reloaded with a different compact disc and returned to the retailer for sale. Alternatively, a retailer may choose to allow the purchaser of a compact disc to take the security package and its contents home. When the purchaser is ready to use the compact disc, he or she cuts open the package, preferably across first V-shaped rib 23 of bottom face 13, removes the compact disc container, and disposes of the package.

It is understood that package 1 can be used for storing and displayind the three different types of compact disc containers presently in use. More particularly, each container is elongated, rectangular, and has opposite end portions and a compartment formed in at least one of the end portions for receiving a rectangular storage or "jewel" box containing a digital audio compact disc. The first type of container is shown in FIG. 2 and described above. The second and third types of containers are a rigid plastic container having large viewing openings formed therein, and a transparent, flexible "blister" plastic container.

In summary, the main and novel features of the improved security package include its ability to securely hold and display all three types of existing compact disc containers. In addition, the package of the invention includes a novel lock means which releasably locks the package cover in the closed position to prevent removal of a compact disc container from the storage compartment through the access opening. The aforesaid lock means is different from and more complicated than the lock means of prior security packages to more effectively thwart retail store compact disc thiefs.

Accordingly, the improved compact disc security package is simplified, provides an effective, safe, inexpensive, and efficient device which achieves all the enumerated objective, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved compact disc security package is constructed and used, the characteristics of the construction, and the advantageous, new and useful results obtained; the new and useful structures, devices, elements arrangements, parts, and combinations are set forth in the appended claims.

What is claimed is:

1. A package construction for holding an elongated, rectangular container of the type having opposite end portions and a compartment formed in at least one of said end portions for receiving a rectangular storage box containing a digital audio compact disc, said package including:

(a) a housing formed out of a piece of material and having a storage compartment formed therein, said compartment having an access opening for inserting and removing a compact disc container into and from the compartment, said housing being formed by an elongated, generally rectangular integral one-piece member having a generally closed end and a generally opposite open end which provides the access opening, and having spaced top and bottom faces, a spaced pair of side walls and a closed end wall defining the storage compartment;

(b) a cover integrally formed out of the same piece of material as said housing and pivotally mounted on the housing and movable between open and closed positions for allowing and preventing, respectively, insertion and removal of a compact disc container into and from the access opening of the storage compartment;

(c) lock means for releasably securing the cover in the closed position, said lock means comprising at least one locking tab and at least one camming surface formed on the housing, and further comprising at least one locking projection formed on the cover, so that said locking projection is slideably engageable with the camming surface and locking tab for retaining said cover in the closed position; and (d) separate key means engageable with the housing locking tab for moving said tab out of engagement with the cover locking projection to enable the cover to be slid from locking engagement with the housing and moved to the open position for removing a compact disc container from the storage compartment through the access opening.

2. The package construction defined in claim 1 in which the housing is formed of a semi-transparent polypropylene.

3. The package construction defined in claim 1 in which the housing top face comprises a pair of arcuate-shaped ribs and first and second transverse ribs; in which the pair of arcuate-shaped ribs extends between the closed end wall and the pair of side walls; in which the first transverse rib extends between the side walls and is spaced from the arcuate ribs and the second transverse rib extends between said side walls and is spaced from said first transverse rib; and in which the second transverse rib generally bisects the housing into the closed and open ends.

4. The package construction defined in claim 1 in which a double-hinged plate integrally hingedly connects the cover to the open end of the housing.

5. The package construction defined in claim 1 in which a pair of semicircular-shaped ears extends upwardly from and are generally coplanar with the side walls.

6. The package construction defined in claim 3 in which the housing access opening is defined by the second transverse rib of the housing top face, the housing side walls, and the bottom face of the housing.

7. The package construction defined in claim 3 in which a pair of spaced rectangular cutouts are formed in a first transverse edge of the second transverse rib of the housing top face; in which the first transverse edge is adjacent to the open end of the housing; in which a pair of spaced nubs extends outwardly of a bottom surface of the second transverse rib adjacent to each of the cutouts; and in which a reinforcing rib extends along an opposite second transverse edge of the second transverse rib.

8. The package construction defined in claim 7 in which a spaced pair of the locking tabs is formed on the housing; in which each of the locking tabs is resilient, rectangular-shaped and has a catch formed thereon and a longitudinally extending, semicircular-shaped channel formed therein; in which the locking tabs are formed integrally with the nubs of the second transverse rib of the housing top face and are spaced from said rib; and in which a pair of slots is formed between the locking tabs and the second transverse rib.

9. The package construction defined in claim 8 in which a pair of the camming surfaces is formed on the housing; and in which the pair of camming surfaces comprises the portions of the bottom surface of the second transverse rib of the housing top face adjacent to the cutouts.

10. The package construction defined in claim 9 in which a spaced pair of the locking projections is formed on the cover and project outwardly of said cover, said projections having tapered top surfaces; and in which an undercut is formed in the locking projections, so that upon manual forward sliding engagement of said cover projections with the locking tabs and camming surfaces of the housing, the tapered top surfaces of said projections contact said camming surfaces whereby the camming surfaces urge the projections downwardly against the catches of said tabs causing the resilient tabs to flex downwardly, and said tabs snappingly engage said projection undercuts as the undercuts move past said catches for releasably securing the cover in the closed position.

11. The package construction defined in claim 10 in which the key means is a plate having a pair of tangs projecting outwardly at an angle from one end thereof; and in which an opening is formed in the cover adjacent to each of the pair of locking projections for insertion of the key tangs therethrough, forwardly along the semicircular channels of the locking tabs, and into engagement with the catches of said tabs when said projections are engaged with the tabs, to disengage said tabs from said projections whereby said cover can be slid rearwardly from locking engagement with the housing by engagement of a heel of the plate with a reinforcing rib of the cover.

12. The package construction defined in claim 4 in which the housing bottom face comprises first and second generally V-shaped ribs, first and second transverse ribs, and a spaced pair of longitudinally extending side flanges; in which the first V-shaped rib extends between the closed end wall and the side walls; in which the first transverse rib extends between the side walls and is spaced from the first V-shaped rib and the second transverse rib extends between said side walls and is spaced from said first transverse rib; in which the pair of side flanges extends along the side walls between the second transverse rib and the double-hinged plate; and in which the second V-shaped rib extends between the double-hinged plate and the side flanges and is spaced from the second transverse rib.

13. The package construction defined in claim 4 in which the cover comprises a generally V-shaped rib, a spaced pair of longitudinally extending side flanges, and a transverse end member; in which the pair of side flanges extends between the double-hinged plate and the transverse end member; and in which the V-shaped rib extends between the double-hinged plate and the side flanges.

14. The package construction defined in claim 7 in which a central, inverted generally U-shaped channel is defined by the bottom surface of the second transverse rib of the housing top face and the innermost ones of the nubs; and in which a pair of outer, inverted generally U-shaped channels is formed by the bottom surface of the second transverse rib, the housing side walls, and the outermost ones of the nubs.

15. The package construction defined in claim 13 in which a central guide tab and a pair of outer guide tabs extend outwardly of the transverse end member of the cover; and in which a top surface of the guide tabs is tapered.

16. A package construction for holding a digital compact disc, cassette or cartridge including:

(a) an elongated generally rectangular shaped container having a compartment in one end portion for holding the compact disc, cassette or cartridge;

(b) a one-piece generally rectangular shaped housing formed out of a piece of material and having spaced pairs of walls forming a storage compartment and an access opening at one end for inserting and removing the container into and from said compartment;

(c) a cover formed integrally of a single piece of material with the housing and movably attached at said one end thereof and movable between open and closed positions for allowing and preventing, respectively, insertion and removal of the container into and from the access opening of the storage compartment;

(d) lock means for releasably securing the cover in the closed position, said lock means comprising at least one locking tab formed on either the cover or housing and at least one locking projection formed on the other of said cover or housing and slideably engageable with said locking tab for retaining said cover in the closed position; and (e) separate key means engageable with the locking tab for moving said tab out of engagement with the locking projection to enable the cover to be slid from locking engagement with the housing and moved to the open position for removing the container from the storage compartment through the access opening.

* * * * *